US009271617B2

(12) United States Patent
Zhou

(10) Patent No.: US 9,271,617 B2
(45) Date of Patent: Mar. 1, 2016

(54) RELEASE MECHANISM AND FIXED BLOCK FOR TOILET LIDS

(71) Applicant: Xiaojun Zhou, Shanghai (CN)

(72) Inventor: Xiaojun Zhou, Shanghai (CN)

(73) Assignee: SHANGHAI KOHLER ELECTRONICS, LTD. (CN)

( * ) Notice: Subject to any disclaimer, the term of this patent is extended or adjusted under 35 U.S.C. 154(b) by 707 days.

(21) Appl. No.: 13/631,201

(22) Filed: Sep. 28, 2012

(65) Prior Publication Data

US 2013/0097772 A1 Apr. 25, 2013

(30) Foreign Application Priority Data

Sep. 30, 2011 (CN) ..... 2011 2 0372105

(51) Int. Cl.
*A47K 13/12* (2006.01)
*A47K 13/24* (2006.01)

(52) U.S. Cl.
CPC ..... *A47K 13/24* (2013.01); *A47K 13/12* (2013.01)

(58) Field of Classification Search
CPC ..... E05D 2005/106; E05D 2005/108; E05D 2005/145; E05D 3/02; E05D 5/125; E05D 5/127; E05D 5/128; E05D 5/1022; E05D 5/1055; E05D 5/1061; E05D 5/1072; E05D 5/1077; E05D 7/125; E05D 7/127; E05D 7/128; E05D 7/1022; E05D 7/1055; E05D 7/1061; E05D 7/1072; E05D 7/1077; A47K 13/12
USPC ..... 4/242.1, 236, 240
See application file for complete search history.

(56) References Cited

U.S. PATENT DOCUMENTS

| | | | | | |
|---|---|---|---|---|---|
| 3,825,958 | A * | 7/1974 | Higginson | 4/240 |
| 5,010,601 | A * | 4/1991 | Kobayashi et al. | 4/236 |
| 5,142,740 | A * | 9/1992 | Amaki et al. | 16/381 |
| 5,666,672 | A * | 9/1997 | Birsel et al. | 4/236 |
| 5,901,383 | A * | 5/1999 | Yanagawa et al. | 4/236 |
| D475,271 | S * | 6/2003 | Hannon et al. | D8/323 |
| 7,128,295 | B2 * | 10/2006 | Scown | 244/118.1 |
| 7,581,793 | B2 * | 9/2009 | Hartmann et al. | 297/463.1 |
| 2002/0062518 | A1 * | 5/2002 | Hellwig et al. | 4/240 |

* cited by examiner

*Primary Examiner* — Paul R Durand
*Assistant Examiner* — Nicholas Ros
(74) *Attorney, Agent, or Firm* — Foley & Lardner LLP

(57) ABSTRACT

A release mechanism including a fixed block with a rotating shaft for toilet lids is described. The release mechanism includes a shell, a fixed block, a rotating shaft, and a U-shaped clamping spring. The shell includes a notch for the rotating shaft. The fixed block includes a U-shaped recess that corresponds to the notch on the shell. The rotating shaft rests inside the U-shaped recess and the notch, connecting the toilet lid to the seat ring. The U-shaped clamping spring engages with the U-shaped recess and clamps the rotating shaft in place.

19 Claims, 5 Drawing Sheets

RELEASE MECHANISM AND FIXED BLOCK FOR TOILET LIDS

CROSS-REFERENCE TO RELATED APPLICATIONS

The present application claims the benefit of and priority to Chinese Patent Application 201120372105.1, filed Sep. 30, 2011, the entire contents of which are hereby incorporated by reference in their entirety.

BACKGROUND

The present disclosure relates to toilet lid assemblies, and particularly to a release mechanism (i.e., a mechanism allowing the toilet lid to release from its engagement and move to an open or closed position), and a fixed block for connecting the toilet lid to the toilet seat.

A toilet's lid and seat ring are typically connected together by one or more rotating shafts positioned on each side of the bottom end of the lid. Rotating shaft holes are located on each side of the top end of the seat ring at positions that correspond to the rotating shafts, and are configured to receive the rotating shafts.

Conventional toilet lid assemblies include a toilet lid, a toilet seat, and a lid connection assembly. The lid connection assembly includes a shell that forms an integral piece with the lid, a fixed block, a rotating shaft and screws. The rotating shaft is typically a metal material and is fixed at the central position of the fixed block. The fixed block is typically a plastic material, and a rotating shaft installation hole is located at its central position. The tail portion of the rotating shaft extends out of the fixed block through the installation hole for engagement and installation with the rotating shaft hole on the toilet seat ring. The head portion and the central portion of the rotating shaft are positioned inside the fixed block, and the rotating shaft and the fixed block are configured to have a rigid connection. The fixed block and the shell are also rigidly connected by two screws, and thus the rotating shaft, the fixed block and the shell form a mutual rigid connection.

In this conventional lid connection assembly, the rotating shaft is locked inside the fixed block and cannot be removed. When the lid is flipped (i.e. when the lid is subject to a force far away from the seat ring) in this arrangement, the shell can break as a result of the internal structural stress. If the lid is to be dismantled, moreover, the fixed structure needs to be opened, which is very inconvenient.

SUMMARY

An embodiment of the present disclosure relates to a release mechanism for a toilet lid, including a shell that includes a notch formed on the top of the shell. The release mechanism also includes a fixed block with a U-shaped recess corresponding to the notch on the shell and formed on the top end of the fixed block. The fixed block has a continuous U-shaped groove formed on the bottom surface and the two sides of the U-shaped recess. The release mechanism also includes a U-shaped clamping spring installed inside the U-shaped groove and configured to engage with the U-shaped groove.

The release mechanism further includes a rotating shaft. The rotating shaft is configured to rest in the U-shaped recess on the fixed block. The tail portion of the rotating shaft extends out of the fixed block, and the central portion and head portion of the rotating shaft are positioned in the U-shaped recess. The end surface of the head portion of the rotating shaft attaches to a side of the U-shaped recess. The U-shaped clamping spring clamps the central portion of the rotating shaft.

Another embodiment of the present disclosure relates to a fixed block of a rotating shaft for toilet lids, including a U-shaped recess formed on the top end of the fixed block. The fixed block also includes a continuous U-shaped groove formed on the bottom surface and two sides of the U-shaped recess. The U-shaped groove is configured to engage with a U-shaped clamping spring. The U-shaped clamping spring is configured to clamp the central portion of a rotating shaft. The U-shaped recess is configured to attach to the end surface of a head portion of a rotating shaft.

DETAILED DESCRIPTION

The present disclosure will be described in detail below, with reference to the accompanying drawings and specific embodiments.

Figure 1:
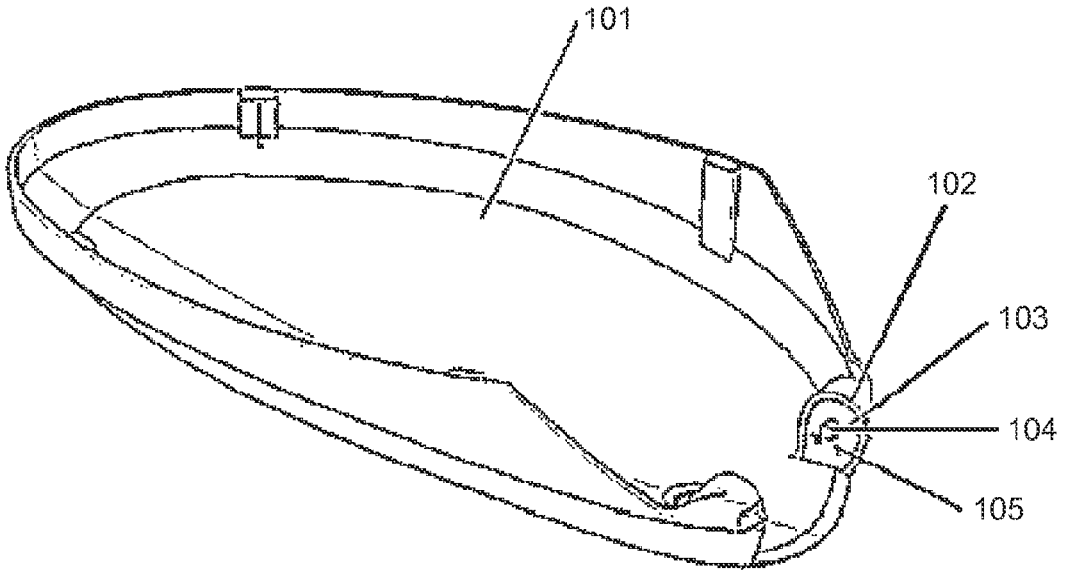
FIG. 1 illustrates a conventional toilet lid.

A toilet lid 101 with a conventional lid connection assembly is shown in FIG. 1. The lid connection assembly includes a shell 102 that forms an integral piece with a lid 101, a fixed block 103, a rotating shaft 104 and screws 105. The rotating shaft 104 is typically a metal material and is fixed at the central position of the fixed block 103. The fixed block 103 is a plastic material, and a rotating shaft installation hole is formed at its central position (not shown in FIG. 1). The tail portion of the rotating shaft 104 extends out of the fixed block 103 through the installation hole for engagement and installation with the rotating shaft hole on the seat ring (not shown in FIG. 1). Portions of the rotating shaft 104 are installed inside the fixed block 103, and the rotating shaft 104 and the fixed block 103 are configured to have a rigid connection. Two screw holes are located on the bottom of the fixed block 103, and two screws 105 form a rigid connection between the fixed block 103 and the shell 102 through the screw holes. Thus, the rotating shaft 104, the fixed block 103 and the shell 102 form a mutual rigid connection.

In this conventional toilet lid connection assembly, the shell 102 can break as a result of the internal structural stress when the lid 101 is flipped by a sufficient force (i.e. when the lid 101 is subject to a force far away from the seat ring). Also, the rotating shaft 104 is locked inside the fixed block 103 and cannot be removed without dismantling the entire assembly.

Figure 2:
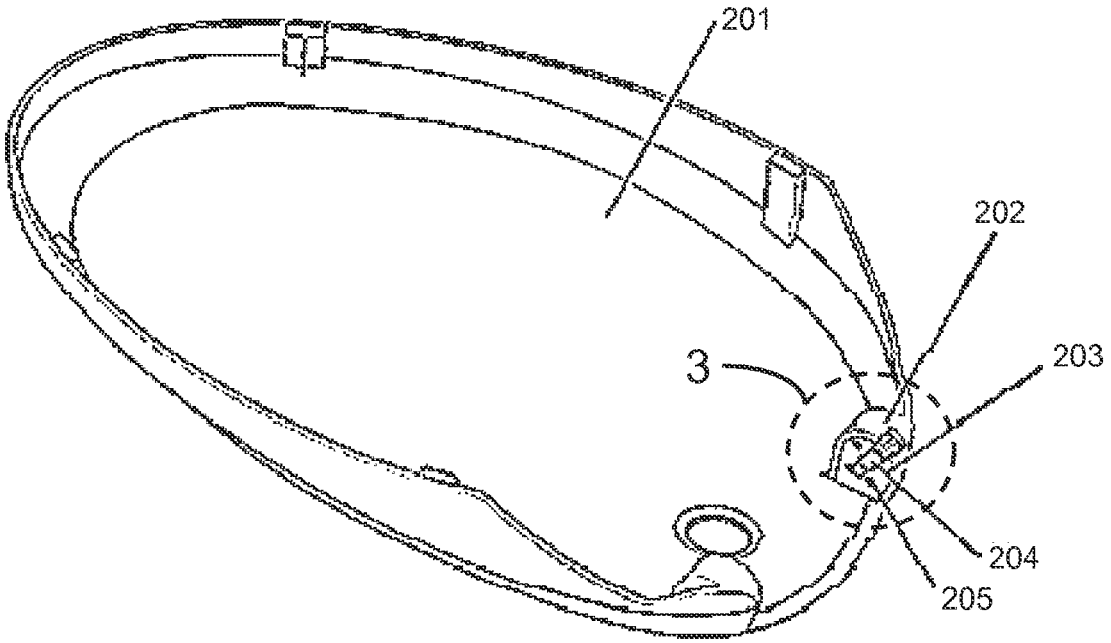
FIG. 2 illustrates a toilet lid with a release mechanism, according to an exemplary embodiment.

A toilet lid 201 with the lid connection assembly of the present embodiment is shown in FIG. 2. This lid connection assembly includes a release mechanism on the side of the bottom end of the lid 201. One or more release mechanisms may be utilized on either side of the lid 201. The release mechanism includes a shell 202 that forms an integral piece with the lid 201, a fixed block 203, a rotating shaft 204, and a plurality of screw installation holes 205 for installing screws. The rotating shaft 204 is installed at the central position of the fixed block 203.

Figure 3:
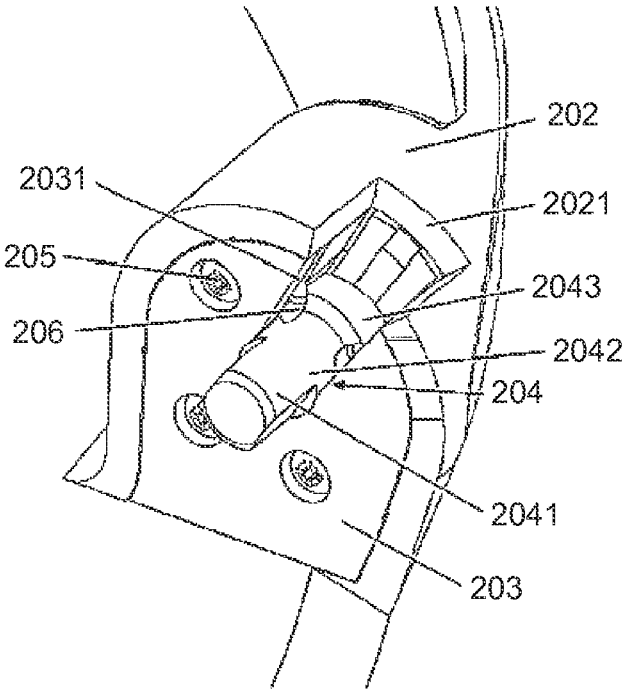
FIG. 3 is an enlarged view of the release mechanism identified in FIG. 2, according to an exemplary embodiment.

The specific structure of the release mechanism in the present embodiment is shown in FIG. 3. A U-shaped recess 2031 is located on the top end of the fixed block 203 at the side closest to the toilet seat ring. A continuous U-shaped groove (not shown in FIG. 3) is formed on the bottom surface and two opposite sides of the U-shaped recess 2031. The U-shaped clamping spring 206 engages with the U-shaped groove and is positioned inside the U-shaped groove.

The rotating shaft 204 is installed to the U-shaped recess 2031 on the fixed block 203 through a notch 2021 on the shell 202. The position and size of the notch 2021 on the shell 202 are proportional to the position and size of the U-shaped recess 2031 on the fixed block 203. The tail portion 2041 of the rotating shaft 204 extends out of the fixed block 203, and the central portion 2042 and head portion 2043 of the rotating shaft 204 are positioned at the bottom of the fixed block 203 in the U-shaped recess 2031. The end surface of the head portion 2043 of the rotating shaft 204 attaches to the innermost vertical side in the U-shaped recess 2031, and the U-shaped clamping spring 206 clamps the central portion 2042 of the rotating shaft 204.

In an exemplary embodiment, the depth of the U-shaped recess 2031 of the fixed block 203 is greater than the diameter of the head portion 2043 of the rotating shaft 204, such that the rotating shaft 204 rests within the fixed block 203.

Figure 4A:
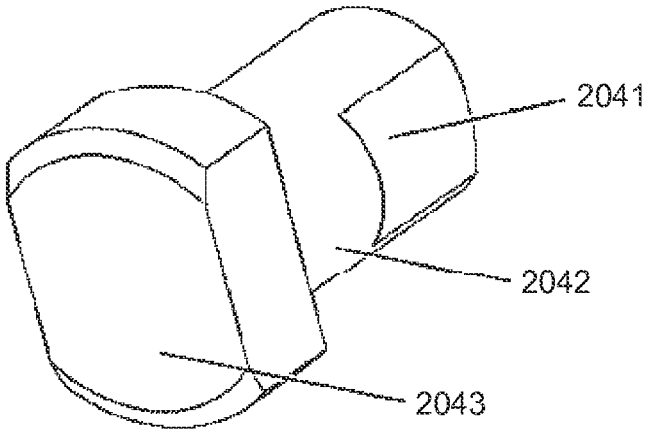
FIG. 4*a* is a three dimensional view from a first angle of the rotating shaft identified in FIG. 3, according to an exemplary embodiment.
Figure 4B:
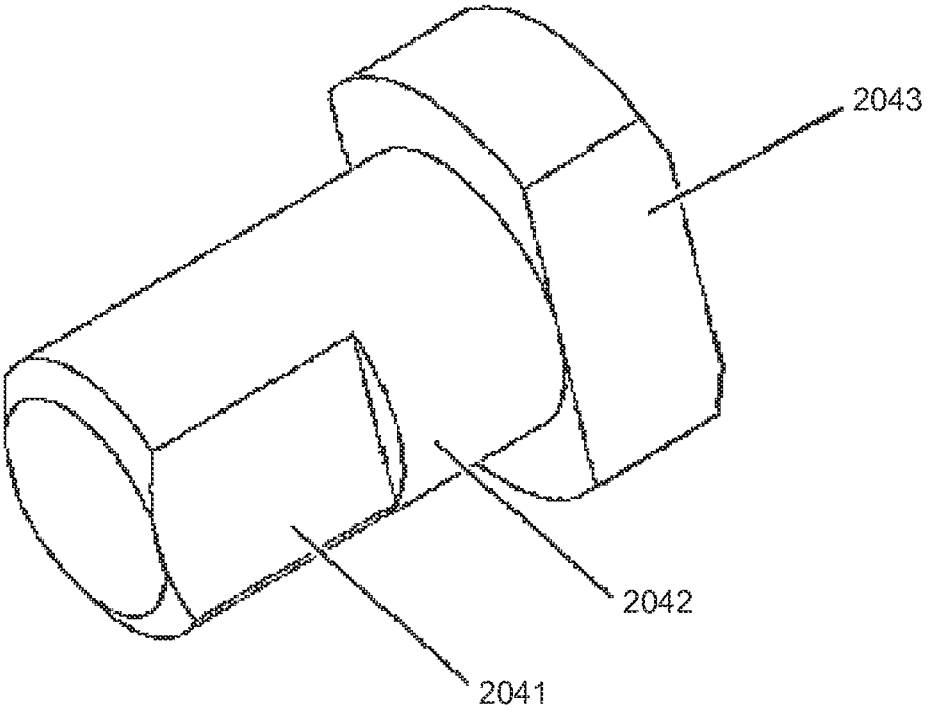
FIG. 4*b* is a three dimensional view from a second angle of the rotating shaft identified in FIG. 3, according to an exemplary embodiment.

The structure of the rotating shaft 204 in an exemplary embodiment is shown in FIG. 4*a* and FIG. 4*b*. In this embodiment, the rotating shaft is in the shape of a screw (or other screw-type fastener). The tail portion 2041 and the central portion 2042 of the rotating shaft of FIG. 4*a* and FIG. 4*b* have a column structure similar to the threaded portion of a screw. The head portion 2043 of the rotating shaft of FIG. 4*a* and FIG. 4*b* is similar to the head portion of a screw, which is a column structure coaxial with the tail portion 2041 and the central portion 2042 of the rotating shaft 204.

In this embodiment, the tail portion 2041 and the central portion 2042 of the rotating shaft of FIG. 4*a* and FIG. 4*b* are in the shape of a cylinder, with the tail portion 2041 formed by beveling two sides of a portion of the cylinder. The un-beveled portion forms the central portion 2042 of the rotating shaft of FIG. 4*a* and FIG. 4*b*. The head portion 2043 of the rotating shaft of FIG. 4*a* and FIG. 4*b* is in the shape of a cylinder, and may be formed by tangentially beveling the two sides of the larger cylinder. The beveled surface of the head portion 2043 of the rotating shaft of FIG. 4*a* and FIG. 4*b* is parallel to the beveled surface of the tail portion 2041 of the rotating shaft.

In an exemplary embodiment, the diameter of the head portion 2043 of the rotating shaft of FIG. 4*a* and FIG. 4*b* is greater than the diameters of the tail portion 2041 and the central portion 2042 of the rotating shaft. The tail portion 2041 and central portion 2042 of the rotating shaft of FIG. 4*a* and FIG. 4*b* thus form a step structure with the head portion 2043 of the rotating shaft. As shown in FIG. 4*a* and FIG. 4*b*, the end surface of the head portion 2043 of the rotating shaft and the end surface of the tail portion 2041 of the rotating shaft are formed with chamfer angles in exemplary embodiments.

Figure 5:
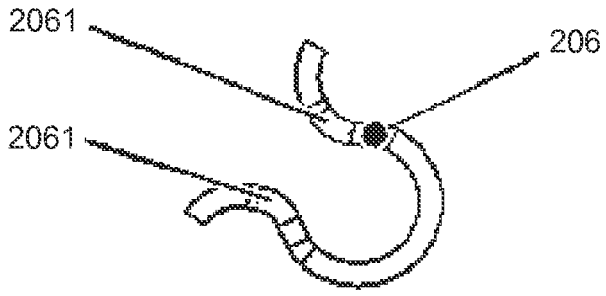
FIG. 5 is an isolated view of the clamping spring identified in FIG. 3, according to an exemplary embodiment.

The structure of the U-shaped clamping spring 206 is shown in FIG. 5, according to an exemplary embodiment. The bottom edge of the U-shaped clamping spring 206 is an arc, which matches the curvature of the central portion 2042 of the rotating shaft 204. Two side edges of the U-shaped clamping spring 206 are provided with two arc bending portions 2061. The top ends of the two arc bending portions 2061 extend outward, and the distance between the two arc bending portions 2061 is smaller than the diameter of the central portion 2042 of the rotating shaft 204.

Figure 6:
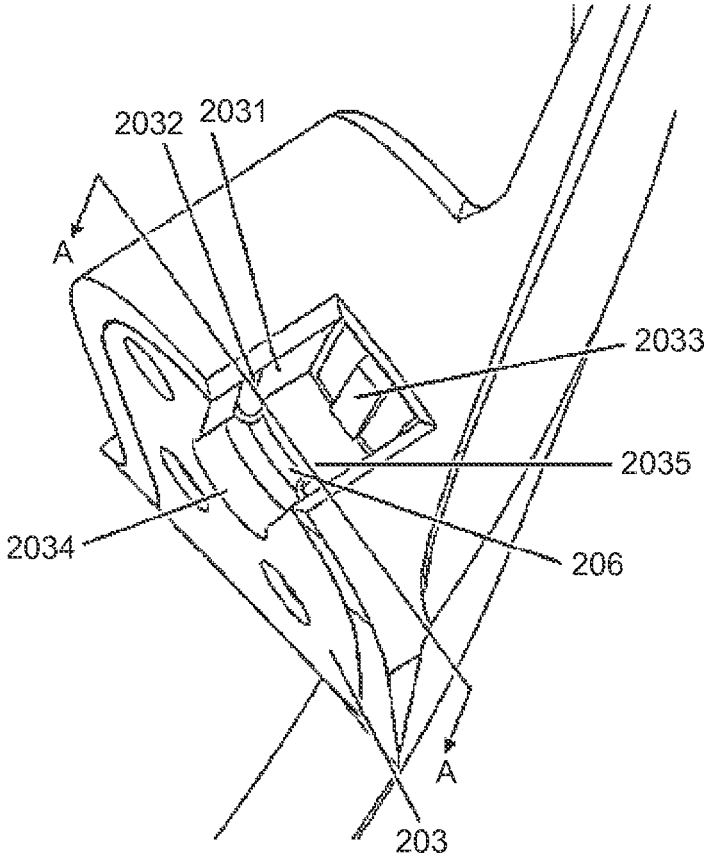
FIG. 6 is a view of the clamping spring when installed in the U-shaped groove, according to an exemplary embodiment.

As shown in FIG. 6, the present embodiment includes a continuous U-shaped groove 2032 formed on the bottom surface and two opposing sides of the U-shaped recess 2031 of the fixed block 203. The groove 2032 extends from the top ends of two opposing sides to the bottom surface of the U-shaped recess 2031. The U-shaped clamping spring 206 engages with the U-shaped groove 2032 and is positioned inside the U-shaped groove 2032.

The bottom surface of the U-shaped recess 2031 is a curved surface 2034 and a stepped surface 2035 from the edge of the fixed block 203 to the innermost portion of the fixed block 203. The curvature and length of the curved surface 2034 match the curvature and length of the central portion 2042 of the rotating shaft 204. The width and height of the stepped surface 2035 match the width and height of the step structure formed by the central portion 2042 of the rotating shaft 104 and the head portion 2043 of the rotating shaft 104. The U-shaped groove 2032 is located on the curved surface 2034 at a position where it is connected to the stepped surface 2035.

As shown in FIG. 6, a long rib 2033 is positioned within the U-shaped recess 2031 on the innermost vertical side. The long rib 2033 runs from the top end of the U-shaped recess 2031 to the bottom end of the U-shaped recess 2031.

Figure 7:
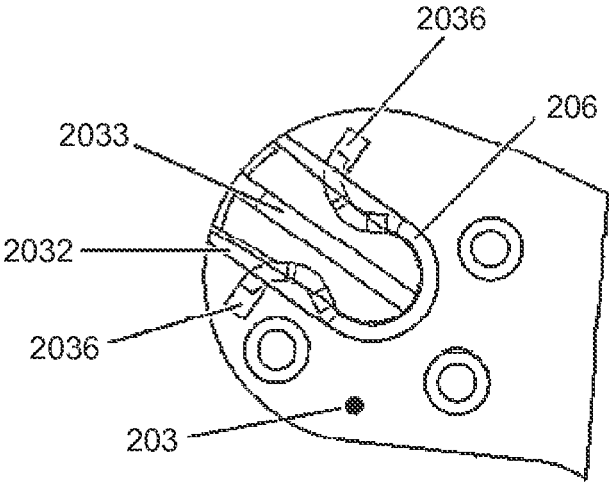
FIG. 7 is a cross-sectional view of the fixed block and the clamping spring in the A-A direction identified in FIG. 6.

A cross-sectional view of the U-shaped clamping spring 206 within the fixed block 203 is shown in FIG. 7. In the present embodiment, a through-hole 2036 is located in the U-shaped groove 2032 on the two opposite sides of the U-shaped recess 2031 on the fixed block 203. The arc bending portions 2061 of the U-shaped clamping spring 206 have top ends that extend outward. The top ends of the arc bending portions 2061 engage with the through-holes 2036 of the U-shaped groove 2032.

In an exemplary embodiment of the release mechanism, when the lid 201 is installed, the rotating shaft 204 is placed in the U-shaped recess 2031 of the fixed block 203 through the notch 2021 on the shell 202. The rotating shaft 204 is installed by exerting a pressure to overcome the resistance from the U-shaped clamping spring 206. This resistance may be overcome by pushing the two bending portions 2061 of the U-shaped clamping spring 206 outward, elastically deforming the two bending portions 2061 and allowing the rotating shaft 204 to enter the U-shaped recess 2031 of the fixed block 203. The lid 201 can then be installed onto the rotating shaft 204.

In an exemplary embodiment, when the lid 201 is dismantled, a force is applied in the opposite direction to overcome the resistance from the U-shaped clamping spring 206. The rotating shaft 204 may then be disengaged from the U-shaped recess 2031, thereby completing the disassembly. In this embodiment, two ends of the bending portions 2061 of the U-shaped clamping spring 206 extend to the through-holes 2036 in the case of elastic deformation. This ensures that the U-shaped clamping spring 206 develops sufficient elastic deformation to disengage the rotating shaft 204 and also prevents the U-shaped clamping spring 206 from disengaging along with the disengagement of the rotating shaft 204.

The present disclosure may be implemented by forming a recess on a fixed block and a notch on a shell, and by installing a clamping spring in the recess to clamp a rotating shaft. The shape of the rotating shaft, the shape of the recess, the shape of the notch, and the shape of the clamping spring are not limited to those in FIG. 3-FIG. 7. The present disclosure, including a release mechanism with a U-shaped clamping spring, may make the assembly and disassembly of the lid easier, and may prevent the shell from breaking when the lid is subject to a high external force far away from the seat ring.

What is claimed is:

1. A release mechanism for a toilet lid, comprising:

a shell, including a notch formed on the top of said shell;

a fixed block, including a U-shaped recess corresponding to the notch on said shell and formed on a top end of the fixed block, a continuous U-shaped groove formed on a bottom surface and two sides of the U-shaped recess;

a U-shaped clamping spring installed inside the U-shaped groove and configured to engage with the U-shaped groove; and a rotating shaft comprising a tail portion, a central portion, and a head portion;

wherein said rotating shaft is configured to rest in the U-shaped recess on the fixed block, the tail portion of said rotating shaft extending out of the fixed block, the central portion and the head portion of said rotating shaft positioned in the U-shaped recess, an end surface of the head portion of the rotating shaft attaching to a side of the U-shaped recess, and the U-shaped clamping spring clamping the central portion of said rotating shaft;

wherein said rotating shaft is in the shape of a screw, the tail portion and central portion of the rotating shaft forming a column structure, the head portion of the rotating shaft coaxial with the tail and central portions and forming the head portion of the screw shape;

wherein the tail portion of the rotating shaft is formed by beveling two sides of a front portion of a cylinder, the un-beveled portion forming the central portion of said rotating shaft, and the head portion is formed by tangentially beveling two sides of a cylinder, the beveled surface of the head portion being parallel to the beveled surface of the tail portion of the rotating shaft;

wherein a diameter of the head portion of the rotating shaft is greater than diameters of the tail portion and the central portion of the rotating shaft, such that the tail portion and the central portion of said rotating shaft form a step structure with the head portion of the rotating shaft, respectively;

wherein the bottom surface of the U-shaped recess of said fixed block is a curved surface and is a stepped surface from an edge of the fixed block to an innermost portion of the fixed block.

2. The release mechanism as in claim 1, wherein the end surface of the head portion of the rotating shaft and the end surface of the tail portion of the rotating shaft are formed with chamfer angles.

3. The release mechanism as in claim 1, wherein the fixed block further comprises a plurality of screw installation holes.

4. The release mechanism as in claim 1, wherein a curvature and length of said curved surface match a curvature and length of the central portion of said rotating shaft, and a width and height of said stepped surface match a width and height of the step structure formed by the central portion of said rotating shaft and the head portion of the rotating shaft.

5. The release mechanism as in claim 4, wherein the U-shaped groove is formed in the U-shaped recess at a position where it is connected to the curved surface and to the stepped surface.

6. The release mechanism as in claim 5, wherein the U-shaped recess includes a long rib located on an innermost vertical side, the long rib running from a top end of the U-shaped recess to a bottom end of the U-shaped recess.

7. The release mechanism as in claim 5, wherein a depth of the U-shaped recess is greater than the diameter of the head portion of the rotating shaft, such that the rotating shaft is positioned within the fixed block.

8. The release mechanism as in claim 5, wherein a bottom edge of the U-shaped clamping spring is arc-shaped, matching the curvature of the central portion of said rotating shaft, and the U-shaped clamping spring includes two arc bending portions on side edges thereof, top ends of the two arc bending portions extending outward, a distance between the two arc bending portions being smaller than the diameter of the central portion of the rotating shaft.

9. The release mechanism as in claim 8, wherein through-holes are formed on the U-shaped groove at two opposite sides in said U-shaped recess and at positions corresponding to the top ends of the two arc bending portions of said U-shaped clamping spring.

10. A fixed block of a rotating shaft for toilet lids, comprising:

a U-shaped recess formed on the top end of said fixed block; and a continuous U-shaped groove formed on a bottom surface and two sides of said U-shaped recess, and configured to engage with a U-shaped clamping spring;

wherein the U-shaped clamping spring is configured to clamp a central portion of a rotating shaft, and the U-shaped recess is configured to attach to an end surface of a head portion of the rotating shaft;

wherein the bottom surface of the U-shaped recess is a curved surface, and is a stepped surface from an edge of the fixed block to an innermost portion of the fixed block, and said U-shaped groove is positioned in the U-shaped recess so that it is connected to the curved surface and to the stepped surface.

11. The fixed block as in claim 10, wherein a curvature and length of said curved surface match a curvature and length of the central portion of said rotating shaft, and a width and height of said stepped surface match a width and height of a step structure formed by the central portion of said rotating shaft and the head portion of the rotating shaft.

12. The fixed block as in claim 10, wherein through-holes are formed on the U-shaped groove at two opposite sides in said U-shaped recess and at positions corresponding to top ends of two arc bending portions of said U-shaped clamping spring.

13. The fixed block as in claim 10, wherein a depth of the U-shaped recess is greater than a diameter of the head portion of the rotating shaft, such that the rotating shaft is positioned within the fixed block.

14. The fixed block as in claim 10, wherein said fixed block further comprises a plurality of screw installation holes.

15. A fixed block of a rotating shaft for toilet lids, comprising:

a U-shaped recess formed on the top end of said fixed block; and a continuous U-shaped groove formed on a bottom surface and two sides of said U-shaped recess, and configured to engage with a U-shaped clamping spring;

wherein the U-shaped clamping spring is configured to clamp a central portion of a rotating shaft, and the U-shaped recess is configured to attach to an end surface of a head portion of the rotating shaft;

wherein the U-shaped recess includes a long rib located on an innermost vertical side, the long rib running from a top end of the U-shaped recess to a bottom end of the U-shaped recess.

16. The fixed block as in claim 15, wherein a curvature and length of said curved surface match a curvature and length of the central portion of said rotating shaft, and a width and height of said stepped surface match a width and height of a step structure formed by the central portion of said rotating shaft and the head portion of the rotating shaft.

17. The fixed block as in claim 15, wherein through-holes are formed on the U-shaped groove at two opposite sides in said U-shaped recess and at positions corresponding to top ends of two arc bending portions of said U-shaped clamping spring.

18. The fixed block as in claim 15, wherein a depth of the U-shaped recess is greater than a diameter of the head portion of the rotating shaft, such that the rotating shaft is positioned within the fixed block.

19. The fixed block as in claim 15, wherein said fixed block further comprises a plurality of screw installation holes.

* * * * *